United States Patent [19]

Brown et al.

[11] Patent Number: 4,748,990

[45] Date of Patent: Jun. 7, 1988

[54] COSMETIC APPLICATOR

[75] Inventors: Jeffrey M. Brown, Suffern, N.Y.; George S. Lepore, Cliffside Park; Neil D. Scancarella, Wyckoff, both of N.J.

[73] Assignee: Avon Products, Inc., New York, N.Y.

[21] Appl. No.: 867,857

[22] Filed: May 28, 1986

[51] Int. Cl.[4] ..... A45D 44/18

[52] U.S. Cl. ..... 132/79 A; 132/85; 132/88.5

[58] Field of Search ..... 132/79 A, 85, 88.5, 132/88.7; 401/183, 288, 286, 281

[56] References Cited

U.S. PATENT DOCUMENTS

| | | | |
|---|---|---|---|
| 1,044,996 | 11/1912 | Cuthbertson | 401/188 |
| 1,112,193 | 9/1914 | Carleton etl. | 401/281 |
| 1,481,499 | 1/1924 | Bongiovanni | 401/281 |
| 2,167,523 | 7/1939 | Reichenbach | 401/281 |
| 2,382,314 | 8/1945 | Herb | 401/188 |
| 2,945,252 | 7/1960 | Martineau, Jr. | 401/183 |
| 4,602,651 | 7/1986 | Roppatte, Jr. | 132/88.5 |

*Primary Examiner*—Gregory E. McNeil
*Attorney, Agent, or Firm*—S. Michael Bender

[57] ABSTRACT

A cosmetic applicator having a squeezable, flexible walled container for storing a liquid cosmetic, and bottle cap means threadedly engaged on the neck portion of the container. The cap means has integrally associated therewith a bristle brush assembly and removable overcap means for covering the brush and sealing it against outside air when it is not in use. Sealing plug means fixedly secured in the opening of the container neck between the bottle cap means and the interior of the squeezable container cooperates with the bottle cap means to provide a valve means adapted to open or close in varying extends a central axial passage disposed commonly with respect to the bottle cap means and brush assembly whereby relative angular rotation of the bottle cap means relative to the container acts to vary precisely the amount of liquid cosmetic material flowing through the aforementioned central passage common to said bottle cap means and said brush assembly upon squeezing of the flexible walls of the container.

20 Claims, 7 Drawing Sheets

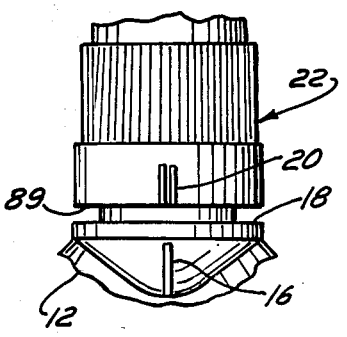
FIG. 4a
FIG. 4
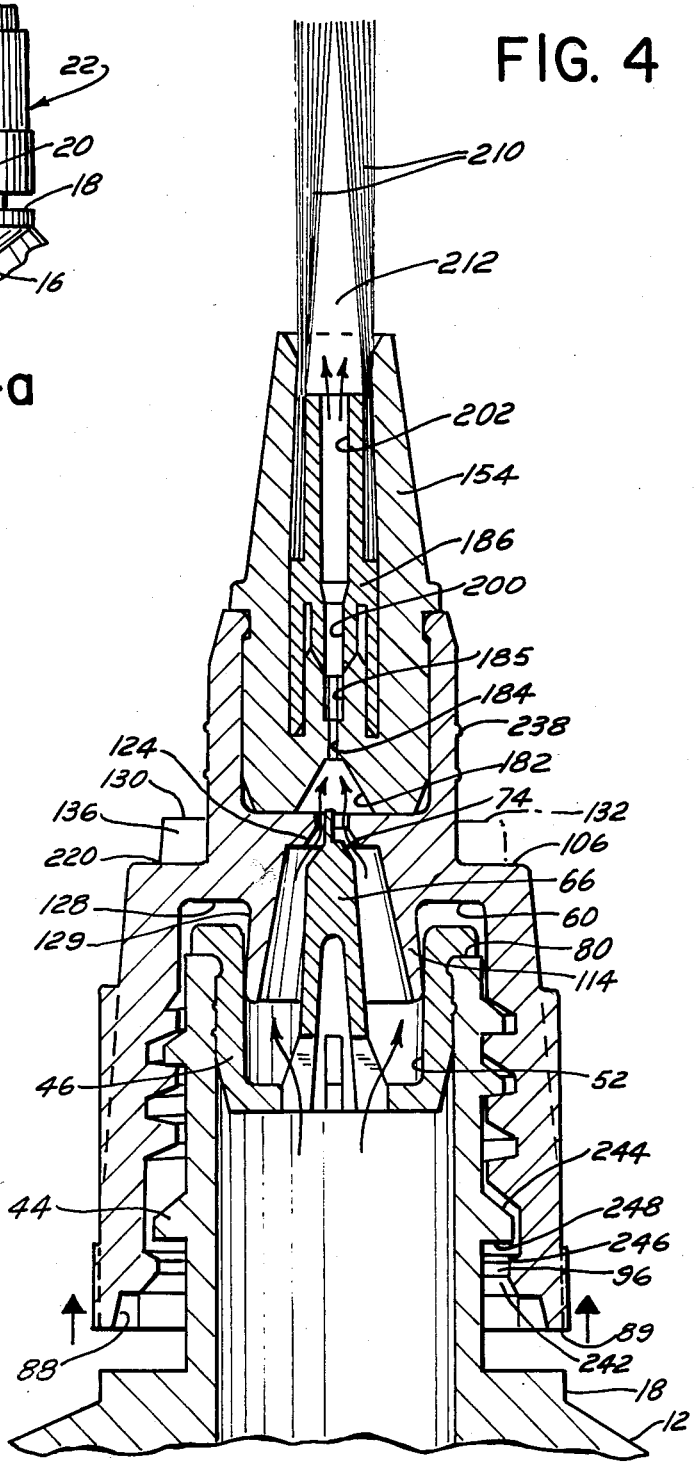

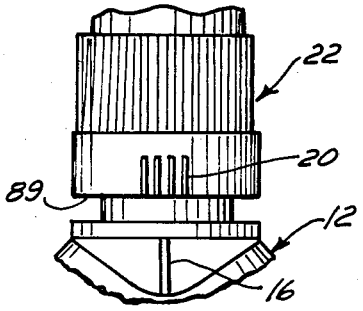
FIG. 5a
FIG. 5
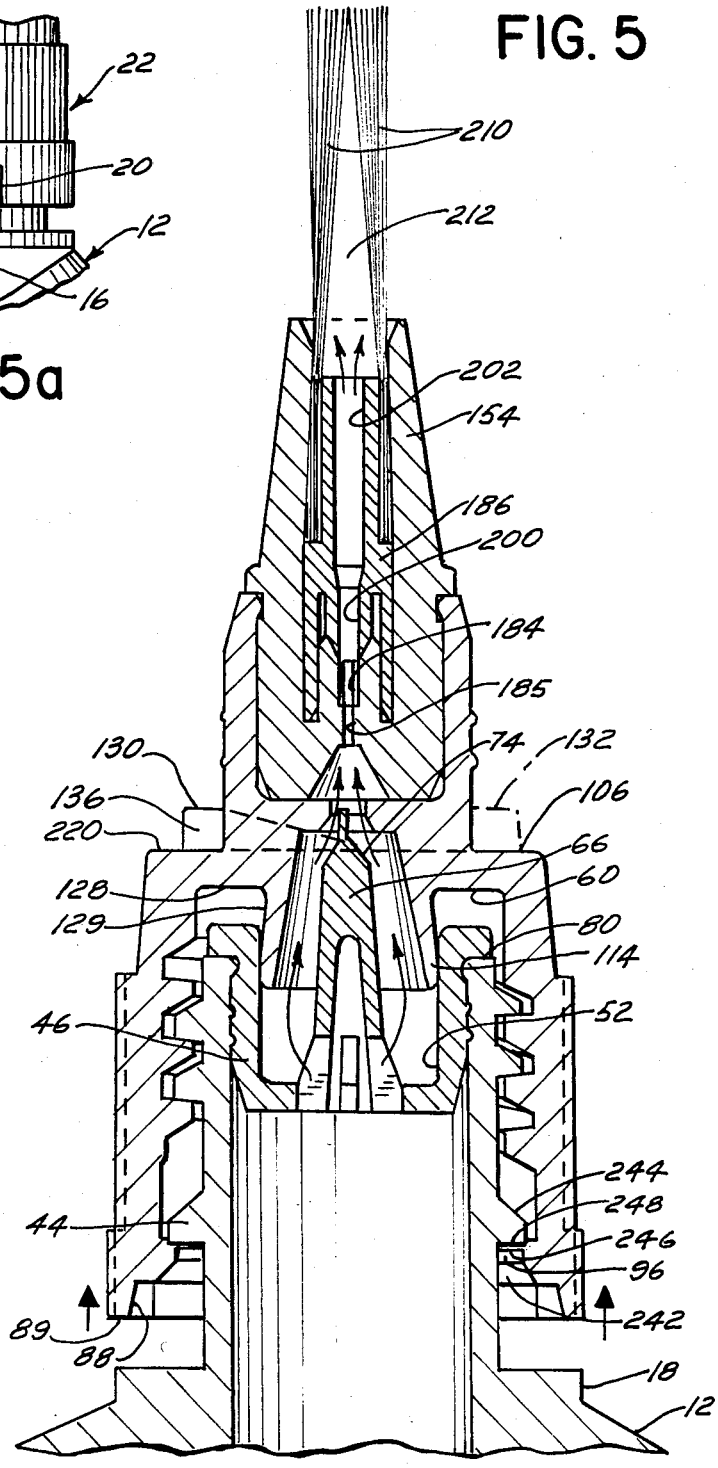

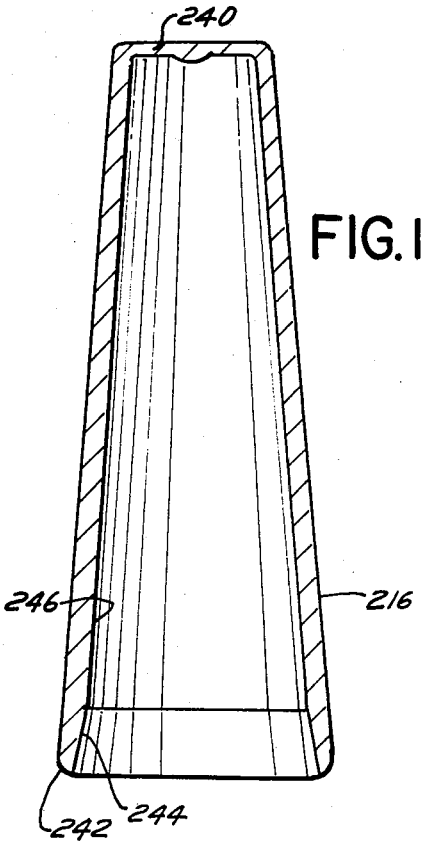
FIG. 13
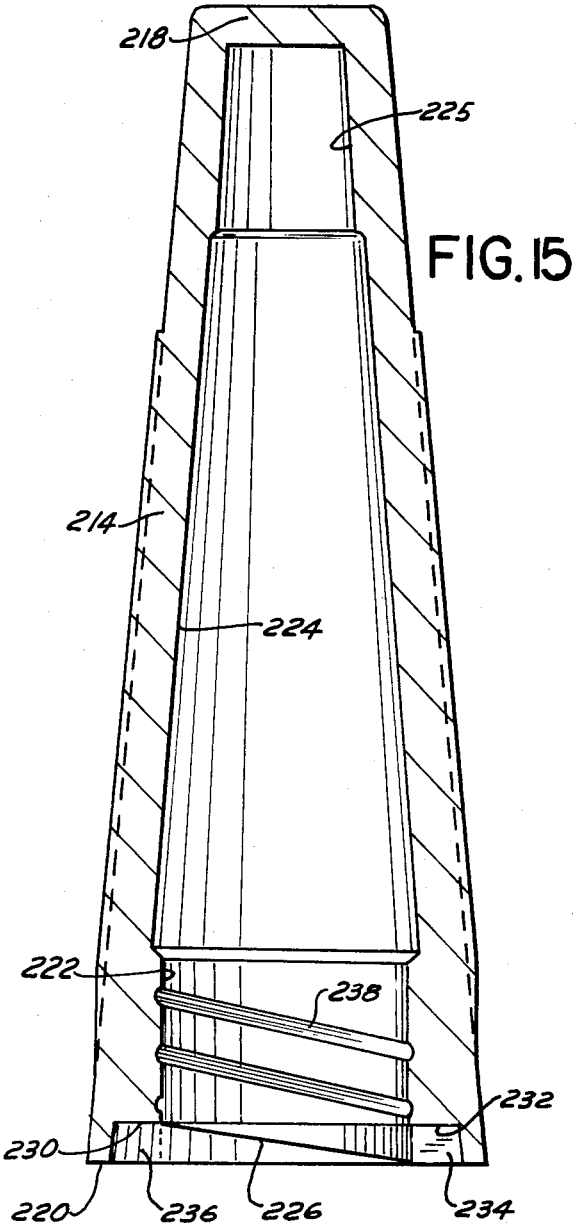
FIG. 15
FIG. 12
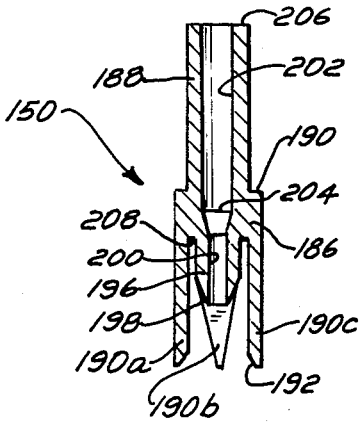
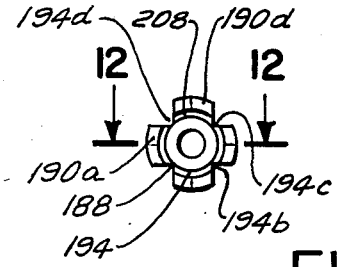
FIG. 11
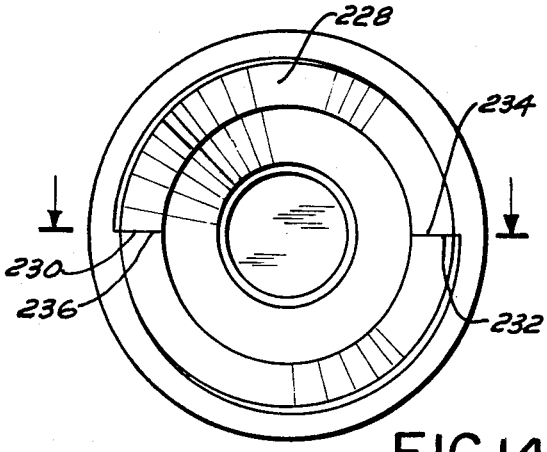
FIG. 14

COSMETIC APPLICATOR

The present invention relates generally to improved cosmetic applicators, and more particularly, to a novel cosmetic applicator featuring a liquid cosmetic storage container having flexible walls capable of being "squeezed" by the user, and a brush and nozzle assembly integrally attached to and communicating with the container.

Integrated applicators of the foregoing general character have been proposed in the prior art for purposes of applying a coating or layer of liquid cosmetic material to the nails, typically a colored lacquer or enamel, but which also may be used to apply a top or base coating, nail polish remover, or other well known liquid cosmetic. They offer distinct advantages over the commonly used glass "nail enamel" bottle which features a separate brush element affixed to the bottle closure or cap and therefore requires manipulation by two hands. Furthermore, because of the glass material used for the container, the latter is breakable, and in any event can be spilled quite easily during use.

While the prior integrated applicators featuring a "squeezable" container can be manipulated with one hand, and generally, are not easily breakable, or spillable, they still suffer from certain disadvantages.

In Fuller et al., U.S. Pat. No. 2,905,956, the bristles of the brush are mounted in a plug carried at one end of a barrel-like or cylindrical container having flexible, squeezable walls. The interior of the barrel communicates with the the bristle array through a central bore. However, Fuller et al's applicator has no provision for varying or adjusting the flow of the liquid cosmetic through the bore, or for positively sealing the bore from liquid flow when the cap is installed. In addition, Fuller et al recommend that the container comprise Nylon material, a substance which may not easily be fabricated into a squeezable container.

Snable, U.S. Pat. No. 2,994,897 discloses the concept of a rudimentary flow control means between the squeezable container and the brush assembly mounted in the neck of the container. Thus, Snable suggests the use of a slit in the bottom of a central sleeve between the brush and the interior of the container which may be opened under the pressure of the liquid occasioned by flexing or squeezing of the walls of the container. Alternatively, Snable suggests the use of a one-way flapper valve. Nevertheless, Snable's flow control means is incapable of adjustably controlling the flow of fluid to the brush and is vulnerable to leakage through the brush assembly. Moreover, Snable recommends polyethylene as the material for the flexible walled container, a substance which is not adequately resistant to nail enamel compositions.

Griffith, U.S. Pat. No. 3,665,290, features a relatively complicated spring-loaded nozzle for controlling on-off flow of enamel from the squeezable container to the brush assembly. When the cap is threadedly disengaged from the container neck, an axially shiftable frontspiece moves away from the container under the force of the spring to open a flow passage to the brush assembly. Re-engagement of the cap against the force of the spring is necessary to seal the flow passage and avoid leakage through the brush assembly. Additionally, the flow passage, when open, delivers the liquid cosmetic to the outside peripheral regions of the bristle cluster, a condition which prevents application of a smooth, even layer of cosmetic material, and which furthermore, tends to leave a residue on the brush assembly susceptible of hardening the bristles.

In Griffith, U.S. Pat. No. 4,040,753, the overly complicated spring-loaded, axially shiftable flow valve requiring engagement with the cap member is dispensed with in favor of a diaphragm supported valve member which normally is in a closed condition, but which may be opened by the increase in internal pressure brought about when the container is squeezed. Nonetheless, Griffith U.S. Pat. No. 4,040,753 fails to provide means for adjusting flow of the liquid cosmetic through the nozzle and requires that the liquid material be applied to the outside of the brush assembly. Although both Griffith U.S. Pat. No. 3,655,290 and Griffith U.S. Pat. No. 4,040,753 suggest that the squeezable body member serving as the storage container for the liquid cosmetic material be a resilient, yieldable plastic, none is identified which would enable the routineer to produce a device capable of storing modern nail enamel formulations.

In view of the shortcomings in the prior art devices described above, heretofore it has been impossible to commercially exploit a liquid cosmetic applicator especially adapted to apply nail enamel and the like via a squeezable container having a brush and nozzle assembly integrally attached thereto. Such a device should be simple to manufacture and therefore relatively inexpensive to purchase. It should avoid leakage and the appearance of a hardened residue on the brush bristle under normal conditions of use. The container material should be tough enough to resist breakage and should flex easily and withstand attach by modern nail enamel formulations. It should be manipulatable by one hand and thus, convenient to use. Finally, to suit individual requirements, the device should have an adjustable flow control means to vary with recision the amount of liquid cosmetic material being applied.

The primary object of the present invention is to provide a squeezable container liquid cosmetic applicator having such advantages and features.

Toward the attainment of this and additional objectives and advantages, the present invention briefly described comprises an improved cosmetic applicator having a squeezable, flexible walled container for storing a liquid cosmetic, and bottle cap means threadedly engaged on the neck portion of the container. The cap means has integrally associated therewith a bristle brush assembly and removable overcap means for covering the brush and sealing it against outside air when it is not in use. Sealing plug means fixedly secured in the opening of the container neck between the bottle cap means and the interior of the squeezable container cooperates with the bottle cap means to provide a valve means adapted to open or close in varying extents a central axial passageway disposed commonly with respect to the bottle cap means and brush assembly whereby relative angular rotation of the bottle cap means relative to the container and container neck portion acts to vary precisely the amount of liquid cosmetic material flowing through the aforementioned central passageway common to said bottle cap means and said brush assembly upon squeezing of the flexible walls of the container.

Still further features and advantages of the present invention will be made apparent from the following detailed description of a preferred embodiment thereof with reference to the accompanying drawings wherein.

Figure 3A:
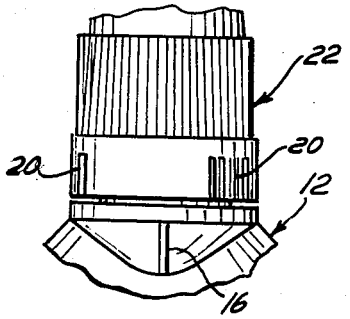
FIG. 3 is a sectional view in elevation of the upper portion of the assembled applicator according to the present invention showing the bottle cap flow control means in the closed condition.

FIG. 3*a* is a fragmentary view in elevation of the upper portion of the assembled applicator showing the alignment of the rotation scale indicia with the applicator container index mark when the bottle cap flow means is in the closed condition.

Figure 3:
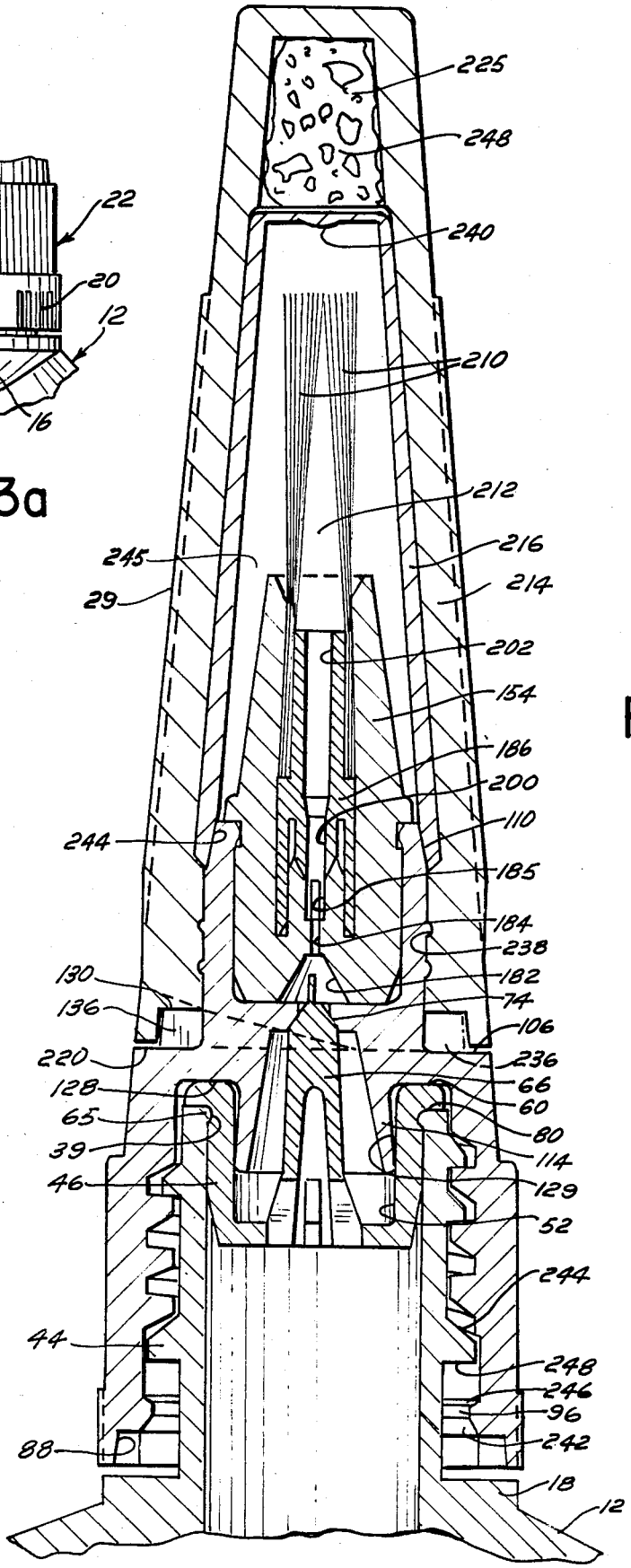

FIG. 4 is the same view as FIG. 3 with the overcap removed for simplicity and showing the bottle cap flow control means in an intermediate position;

FIG. 4*a* is a fragmentary view in elevation of the upper portion of the assembled applicator showing the alignment of the rotation scale indicia with the applicator container index mark when the bottle cap flow means is in the intermediate position.

FIG. 5 is the same view as FIG. 4 showing the bottle cap flow control means in a fully open position;

FIG. 5*a* is a fragmentary view in elevation of the upper portion of the assembled applicator showing the alignment of the rotation scale indicia with the applicator container index mark when the bottle cap flow means is in the fully open position.

Figure 6:
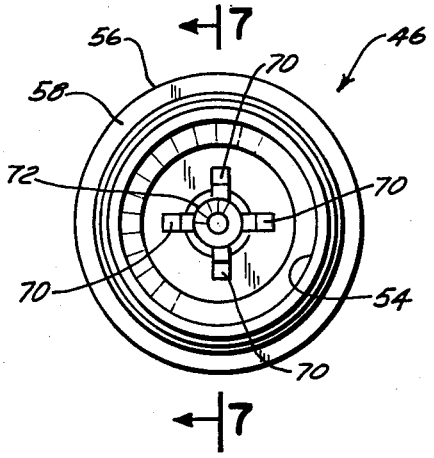
Figure 7:
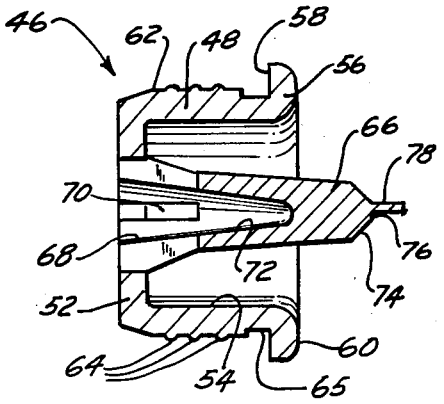
Figure 9:
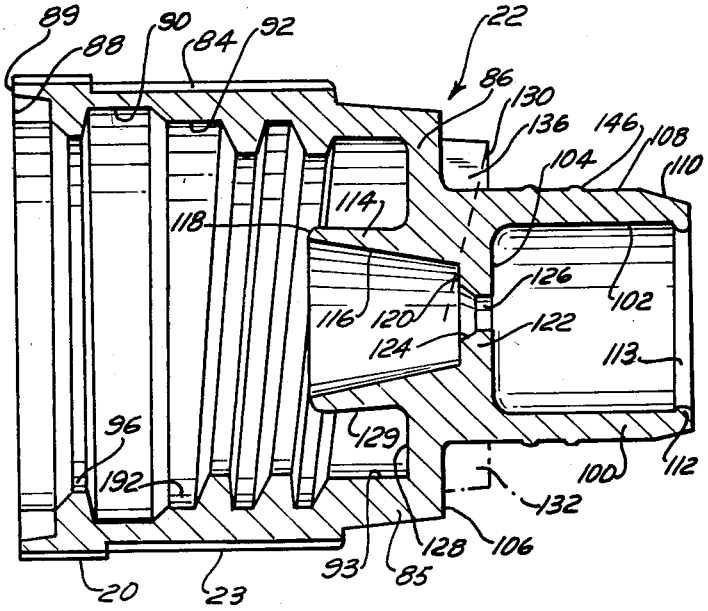
Figure 8:
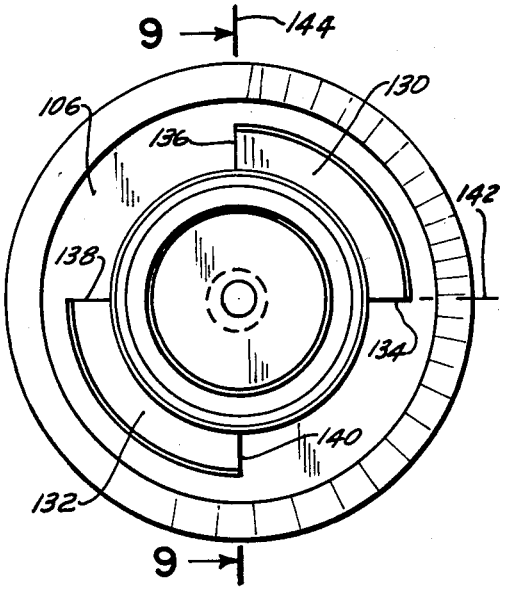
Figure 10:
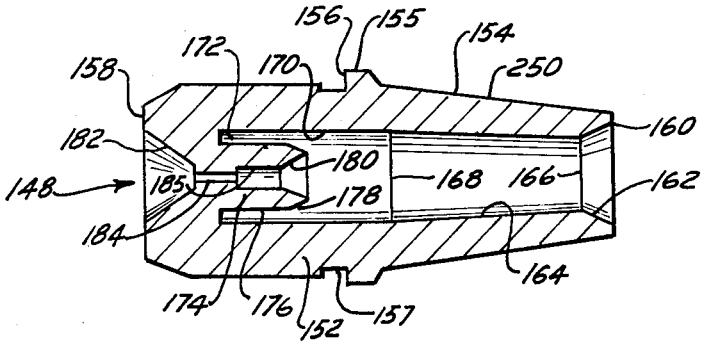
Figure 16:
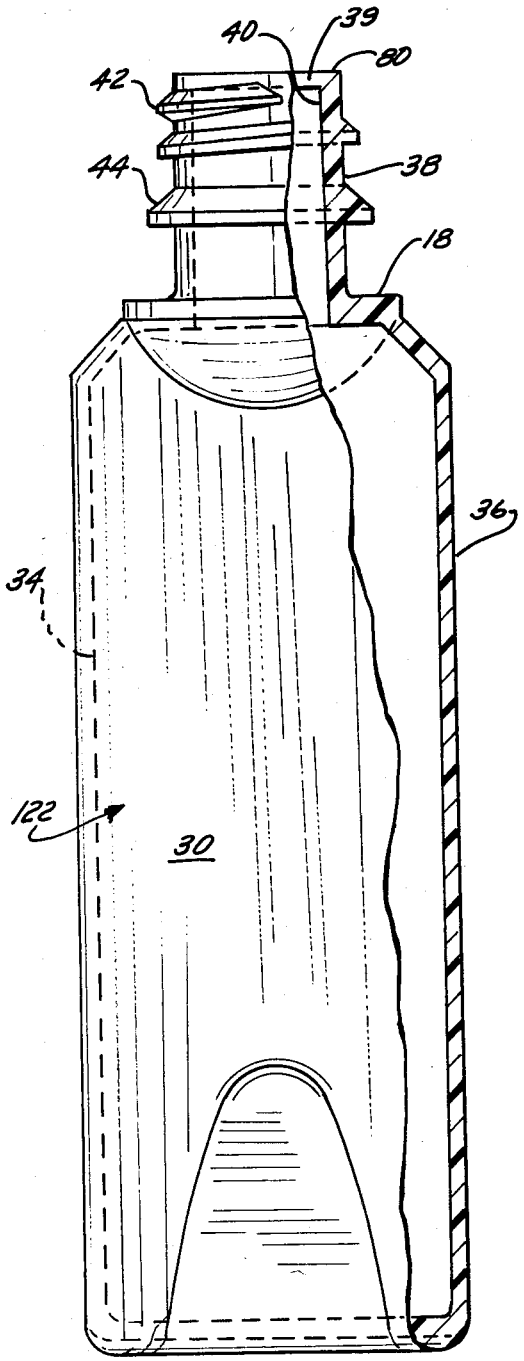
Figure 17:
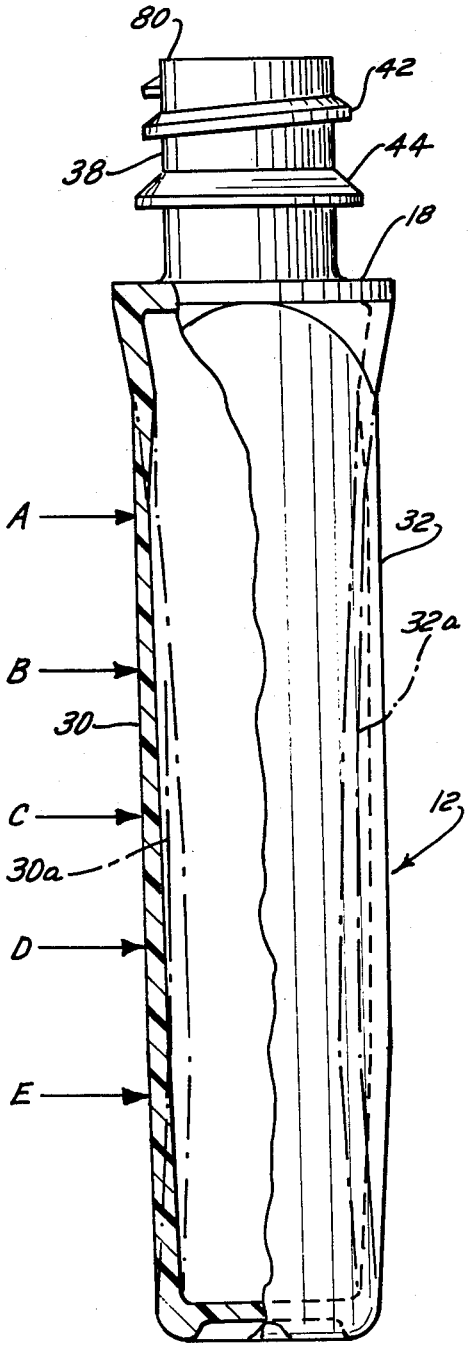

FIG. 6 is a bottom plan view of the sealing plug portion of the present invention;

FIG. 7 is a sectional view taken along line 7—7 of FIG. 6;

FIG. 8 is a plan view of the bottle cap means portion of the present invention;

FIG. 9 is a sectional view taken along line 9—9 of FIG. 8;

FIG. 10 is a sectional view in elevation of the brush holder portion of the present invention;

FIG. 11 is a plan view of the bottom of the brush anchor portion of the present invention;

FIG. 12 is a sectional view taken along line 12—12 of FIG. 11;

FIG. 13 is a sectional view of the inner portion of the overcap member according to the present invention;

FIG. 14 is a plan view of the bottom of the outer portion of the overcap member according to the present invention;

FIG. 15 is a sectional view taken along line 15—15 of FIG. 14;

FIG. 16 is a front view in elevation of the container portion of the present invention shown partially broken away; and FIG. 17 is a side view in elevation of the container portion of the present invention shown partially broken away.

Figure 1:
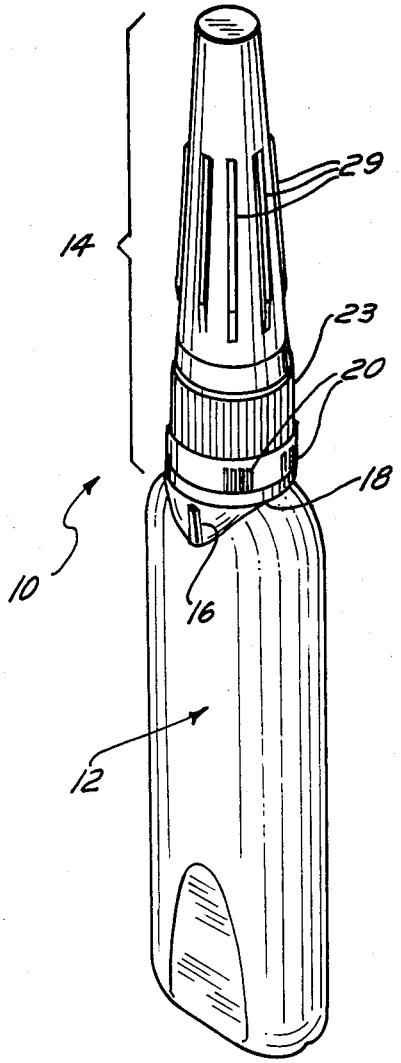
FIG. 1 is perspective rendering of the cosmetic applicator of the present invention.
Figure 2:
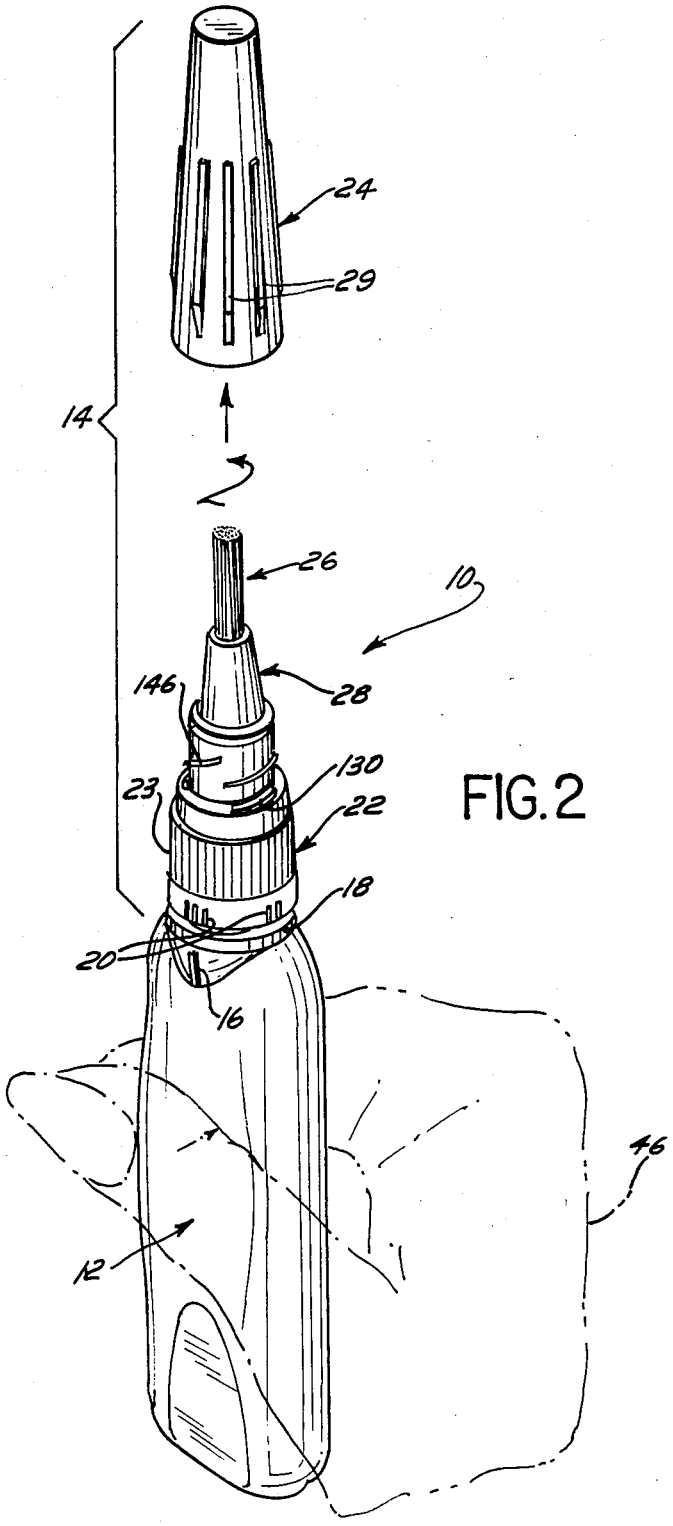
FIG. 2 is the same perspective as FIG. 1, but showing the overcap removed to expose the brush assembly, and further depicting via broken lines an imaginary hand of a user squeezing the container portion of the applicator.

Turning initially to FIGS. 1 and 2, the preferred embodiment of the improved cosmetic applicator according to the present invention is generally indicated by reference numeral 10 and comprises a container 12 preferably of transparent material, and a bottle cap 14. The container 12 is intended to store a liquid cosmetic substance, preferably nail enamel, whose color is rendered visible through the transparent walls of the container, but it will be understood that other liquid cosmetics may be stored instead and that if desired, the container walls may be translucent, colored, or opaque.

As will be explained in much greater detail below, the bottle cap 14 is fixedly secured to the container, but may manually be rotated relative to the container between a closed position (FIG. 1) and a fully open position (FIG. 2) to vary or control the amount of liquid cosmetic material applied via applicator 10. The relative angular orientation between container 12 and bottle cap 14 at any given moment may manually be set anywhere between these extremes (i.e., it is infinitely adjustable), and to facilitate a desired setting, an index mark 16 is disposed proximal to the top flange 18 of container 12 substantially as depicted to register selectably with rotation scale indicia 20 carried on the outer surface of the bottom section 22 of the bottle cap 14. In its preferred form, the scale indicia 20 comprise circumferentially spaced sets of narrow, vertical projections on the peripheral surface of section 22 with the number of projections in each set varying sequentially from one to four in number as more clearly seen in FIGS. 3*a*, 4*a* and 5*a*. Thus, alignment of any set with index mark 16 will determine and render clearly visible a specific angular position of bottle cap 14 relative to container 12. Bottom section 22 carries circumferentially a series of serrations 23 to provide a frictional gripping surface substantially as shown to facilitate rotation of bottom section 22 as, for example, by the thumb and forefinger of the user's hand. As will further be explained in more detail later, bottle cap 14 includes an overcap member 24 which is removable to expose a brush or tuft of bristles 26 extending axially from the free end of a brush holder 28 integral with and carried on top of section 22. And, as illustrated in FIGS. 1 and 2, overcap 24 is provided with a circumferential array of spaced, narrow splines or projections 29 on its outer surface to provide a convenient gripping surface enabling easy installation or removal, again using the thumb and forefinger of the user's hand, if desired.

Referring for the moment to FIGS. 16 and 17, container 12 generally is of elongated, rectangular shape having opposed front and rear walls 30, 32 and opposed side walls 34, 36. The front and rear walls are sufficiently flexible to be flexed or squeezed toward one another by manual pressure. The sidewalls which are relatively narrower than the front and rear walls generally are less squeezable. In order to enhance the ability of front and rear walls 30 and 32 to flex or be squeezed relative to one another, in accordance with the invention the thickness of walls 30, 32 is tapered along the height dimensions of the container from a maximum at points D and E to a minimum at points A, B and C. Preferably, the wall thickness at points A–C is approximately 25% thinner than at points D and E, with the maximum thickness of walls, 30, 32 being in the range of 0.15 inches to 0.40 inches.

Without limitation, a container 12 particularly preferred in practicing the present invention has a front and rear wall thickness of about 0.030 inches (maximum), a side wall thickness of about 0.60 inches, a height measured from base to flange 18 of about 2.55 inches, a depth of about 0.55 inches, and a width of about 0.950 inches. Such dimensions will provide a container having an internal volume sufficient to store about 0.50 oz. of nail enamel or similar liquid cosmetic, which, in turn, will provide approximately 20 coats when applied to the fingernails of a typical user.

Container 12 terminates at its upper end in a cylindrical neck portion 38 extending upwardly from flange 18 and defines therein a central bore or recess 40 through which liquid cosmetic material stored within the interior space of container 12 will be urged to flow under pressure when walls 30, 32 are squeezed relative to one another as indicated generally by broken lines 30a, 32a, in FIG. 17. A cylindrical snap ring 39 integral with neck portion 38 extends circumferentially about the inner surface of bore 40 adjacent the top edge of the container for a purpose which will be made evident below. In the embodiment illustrated, bore 40 preferably has an inside diameter of about 0.350 inches.

Disposed on the cylindrical outer surface of neck portion 38 substantially as shown is a helical male or screw thread 42 of the conventional buttress type. Spaced below thread 42, but above flange 18, is a bevel or stop ring 44 likewise disposed on the outer cylindrical surface of neck portion 38, which stop ring has a substantially flat lower surface to define a shoulder or limit stop extending outwardly with respect to the outside diameter of neck portion 38. The purpose of thread 42 and stop ring 44 will be made apparent during the ensuing discussion of the internal organization of parts comprising bottle cap 14.

Suffice it to say generally at this juncture, with reference again being made to FIGS. 1 and 2, squeezing of the container 12 (i.e., front and rear walls 30, 32) via the user's hand as shown by broken lines 46, will result in the flow of liquid cosmetic from the container to the brush 26, provided, of course, that the bottle cap 14 has been rotated relative to container 12 sufficiently to open a central or axial passageway between the container and the brush as will be explained more fully below. By such action, provided further that overcap 24 has been removed, the liquid cosmetic may conveniently be applied by manipulation of the same hand to a body part or other surface, as for example, the fingernails of the user's other hand.

It will thus be appreciated that the applicator of the present invention is especially preferred for applying liquid cosmetic materials in the form of pigmented or non-pigmented nail enamel or lacquers. Although, as pointed out in this specification, many attempts have been made to develop a commerically successful "squeezable" applicator for applying nail enamel, none has succeeded heretofore due in part to the failure to employ an appropriate material for the squeezable container which exhibits the requisite flexure properties, yet resists chemical and physical change due to the nature of modern nail enamel formulations. In accordance with the present invention, it has been discovered that an acrylic thermoplatics polymeric resin sold by Vistron Corporation under the trademark BARAX 210 is an ideally suited material for container 12. This material not only resists chemical attack by solvent laden nail enamels, but is flexible and tough, leakproof, and may be blow-molded relatively inexpensively to form a transparent container, an important requirement because of the commercial need to have the cosmetic substance stored in the container rendered visible. A container 12 fabricated from the preferred polymeric material may thus store any of the conventional nail enamels in use today, it being understood that the particular formulations of such liquid cosmetics are well known and form no part of the present invention.

Another important feature of the applicator of the present invention, is the provision of flow control means infinitely adjustable between a "closed" and a "fully open" position, interposed between the squeezable container 12 and the brush 26, which flow control means may manually be activated selectably by the user to precisely control the amount of liquid cosmetic material being applied to brush 26 when container 12 is squeezed. Turning now to FIGS. 3–16, such flow control means in its preferred form will be described in detail.

Referring initially to FIGS. 6 and 7 there is provided a central sealing plug 46 comprising a cylindrical wall 48 terminating in an end or bottom wall 52 to define cylindrical recess 54. Wall 48 is tapered inwardly as shown toward the central axis of plug 46 proximal to end wall 52 to facilitate insertion of plug 46 into container neck recess 40 as will be explained more completely below. The opposed or upper edge of wall 48 terminates in a radially extending flange 56 having a lower surface 58 and an upper surface 60. The outer peripheral surface 62 of wall 48 has disposed thereon a plurality of spaced protuberances 64 completely encircling plug 46 substantially as shown. The outer surface of plug member wall 48 preferably includes a circumferential recess 65 of rectangular cross-section adjacent shoulder 58 sized to receive snap-ring 39 therein as soon will be explained.

A frusto-conically shaped, tapered valve stem 66 is joined to end wall 52 via tapered base portion 68 which latter has a series of slots 70 disposed therein every 90° about the circumference of the base portion. Each slot provides communication between a central recess 72 common to the base portion and the proximal portion of valve stem 66, and cylindrical recess 54. Central recess 72, in turn, provides an opening in end wall 52 communicating with the interior of container 12 as will be made more apparent.

The valve stem 66 extends beyond flange 56 and the latter's upper surface 60 and terminates in beveled surface 74 and a substantially flat tip 76 having a spike 78 extending therefrom with the spike 78 being positioned eccentrically or off-center with respect to the central axis of sealing plug 46 more or less as shown.

Turning now to FIGS. 3–5, the sealing plug is interfitted in the central bore or recess 40 of container neck 38 by press fitting this part into the position shown with the bottom surface 58 of flange 56 resting upon the distal edge 80 of the container neck. Preferably, the material of sealing plug 46 is chosen to be somewhat softer then the acrylic resin material of the container and thus, when press-fit into place, the protuberances 64 will deform and tightly wedge the parts together in a secure manner such that sealing plug 46 remains stationary relative to the container neck 38 (and container 12) in which it is interfitted under all conditions of operation. A preferred material for sealing plug 46 in molded polyethylene. Moreover, snap-ring 39 on the inner surface of bore 40 of container neck portion 38 will securely engage recess 65 thus, providing enhanced retention of plug 48 within central recess or bore 40.

As a result of the interfitment of sealing plug 46 within container neck recess 40, it will be appreciated that liquid cosmetic may flow unhindered through recess 40, central recess 72, slots 70, and upper or cylindrical recess 54.

As mentioned, bottle cap 14 is comprised of three main parts namely, a lower section 22, an upper brush holder 28, and an overcap 24 which is designed to be removable from the integrally connected two other parts.

Thus, referring to FIGS. 8 and 9, lower section 22 comprises a base portion 84 having a wall 86 at one end and a central opening or mouth 88 in its opposed other end 89. Base portion 84 generally is cylindrically shaped, but the portion 85 thereof proximal to end wall 86 is of reduced outside diameter and tapered frusto-conically somewhat with respect to the central axis of lower section 22 substantially as depicted. As indicated in FIGS. 1 and 2, the outside surface of the generally cylindrically shaped base portion 84 carries serrations 23 and rotation scale indicia 20. Central opening 88 communicates with a second central recess 90 of reduced inside diameter which, in turn opens into a third central recess 92 of yet further reduced inside diameter. A helical female or nut thread 94 also of the buttress type is disposed on the inside wall of recess 92 whereas a beveled cylindrical stop ring 96 is disposed on the inside wall of recess 90 at the juncture of the recess with central opening 88 substantially as shown. It will be noted in FIG. 9 that stop ring 96 is displaced from the leftmost convolution of thread 94 an axial distance approximately equal to the axial extent of second central recess 90. For reasons which will be made apparent, helical nut thread 94 is complimentary to that of helical screw thread 42, and the diameter of the central opening defined by cylindrical stop ring 96 although greater then the outside diameter of container neck portion 38, is less than the outside diametrical extent of beveled stop ring 44. Also, whereas only the upper surface of stop ring 44 is beveled (its bottom surface is flat), both the upper and lower surfaces of stop ring 96 are beveled substantially as shown. Finally, it will be noted that a fourth recess 93 of reduced inside diameter with respect to recess 92 is provided between thread 94 and end wall 86.

Coaxially disposed relative to wall 86 and extending outwardly therefrom (or to the right as shown in FIG. 9) is a cylindrically shaped socket 100 having a central recess 102 therein opening outwardly at the socket's distal end and having a floor 104 whose surface is displaced with respect to surface 106 of wall 86. The cylindrical outer wall surface 108 of socket 100 is tapered to form a bevel 110 proximal to its distal edge 112. A cylindrical snap-ring 113 integral with the wall of socket 100 extends circumferentially about the inside surface of recess 102 adjacent distal edge 112 as shown.

Also coaxially disposed relative to wall 86, but extending inwardly therefrom into recesses 93 and 92 is a ferrule 114 having a frusto-conically shaped recess 116 extending from its open end 118 to ceiling surface 120 substantially as shown. Thus, there is provided a second wall 122 in section 22 defined by ceiling surface 120 and the surface of floor 104 dividing or separating ferrule recess 116 from socket recess 102. A coaxial passage, however, in the form of frusto-conical opening 124 and through bore 126 is provided between recess 116 and recess 102. The taper of opening 122 is chosen to compliment and sealingly engage the tapered or beveled surface 74 on valve stem 66. Moreover, as will be made apparent, the distance between the outside diameter of ferrule 114 and the inside diameter of recess 93 is chosen to be slightly less than the combined wall thickness of neck portion 38 and wall 48 of sealing plug 46. By this arrangement, the flat surface 128 of wall 86 terminating recess 93 interiorly of section 22 and which concentrically surrounds ferrule 114 between the latter's outside surface 129 and helical thread 94 forms a bearing surface relative to surface 60 of sealing plug 46 which together with the engagement of threads 92 and 42 function to limit rotation of bottle cap 14 in one direction relative to container 12 as will be explained in more detail below. Moreover, as will also be further explained, there will exist, by virtue of the arrangement described above, a tight sealing engagement between the outside surface 129 of ferrule 114 and the inside surface of cylindrical recess 54 of sealing plug 48.

A pair of diametrically opposed ramps 130, 132 are positioned on surface 106 circumferentially with respect to outside surface 108 of socket 100 at the base thereof. Ramp 130 has one end 134 substantially flush with surface 106 and rises for 90° of angular extent of surface 106 (See also FIG. 2) to form a flat surface or shoulder 136 perpendicular to surface 106. Likewise, ramp 132 has one end 138 flush with surface 106 and rises for 90° of angular extent of surface 106 in the opposite direction with respect to ramp 130 to form a flat surface or shoulder 140 perpendicular to surface 106. Shoulders 136, 140 thus are diametrically opposed and oppositely facing with respect to the outside diameter of socket 100 whereas the other ends 134, 138 of ramps 130, 132 flush with surface 106 are also diametrically opposed and oppositely facing with respect to the outside diameter of socket 100. Also, the diametrical plane 142 intersecting ends 134, 138 is rotated 90° relative to the diametrical plane 144 intersecting flat surfaces 136, 140 as depicted in FIG. 8.

A helical thread 146 of cylindrical cross-section is disposed on the outside surface 108 of socket 100 between ramps 130, 132 on the one hand and beveled surface 110 on the other hand. As will be explained in more detail below, the ramps 130, 132 and thread 146 are intended to cooperatively engage related parts on overcap 24.

A brush holder 148 (FIG. 10) and brush anchor 150 (FIGS. 11 and 12) are interfitted with one another and with section 22 to complete the bottle cap 14 sub-assembly. The brush holder 148 comprises a cylindrical plug 152 terminating in a frusto-conical section 154 the base 155 of which is larger then the outside diameter of plug 152 substantially as shown to define a circumferential or annular shoulder 156 spaced from the end 158 of plug member 152 and axial distance substantially equal to the axial extent or depth of recess 102 in socket 100 of section 22. In addition, the outside diameter of plug 152 is slightly greater then the outside diameter or recess 102. As a result, plug 152 may be secured via press fit engagement within socket recess 102 with circumferential shoulder 156 engaging distal end 112 of the socket and end 158 engaging floor 164 of recess 102. Additionally, plug member 152 preferably includes a circumferential recess 157 of rectangular cross-section adjacent shoulder 156 sized to receive snap-ring 113 therein when the parts are interfitted to provide enhanced retention of plug 152 within socket 100.

The distal end 160 of frusto-conical section 154 includes a coaxially aligned frusto-conical recess 162 whose taper extends opposite to the taper of frusto-conical section 154 and toward the opposite end 158 of plug 152 whereupon recess 162 opens into still another frusto-conical recess 164 coaxially oriented with respect to brush holder 148 at a juncture 166 defining the narrowest taper of frusto-conical recess 164. The latter recess extends to its widest taper at juncture 168 where it opens into yet another cylindrical recess 170 coaxially aligned relative to brush holder 148 which recess 170 terminates at internal wall surface 172. Extending from surface 172 and toward frusto-conical recesses 164, 162 and coaxially aligned therewith is a ferrule 174 whose outside cylindrical surface 176 terminates in beveled surface 178. Ferrule 174, in turn, has a central passage defined by a first frusto-conical recess 180 disposed in the end thereof defined by beveled surface 178, a second frusto-conical recess 182 disposed in end 158 of plug 152, and coaxial cylindrical bores 184, 185 interconnecting frusto-conical recesses 180, 182 substantially as shown in FIG. 10. Thus, when brush holder 148 is interfitted with section 22 by press fitting plug 152 into recess 102 of socket 100 and engaging snap-ring 113 in recess 157, a central passage exits comprising recess 116 of ferrule 114, frusto-conical recess 124, bore 126, frusto-conical recess 182, cylindrical bores 184, 185 and frusto-conical recess 180.

Turning now to FIGS. 11 and 12, brush anchor 150 has a cylindrical base portion 186 from which extends a cylindrical nozzle 188 whose outside diameter is less than that of base portion 186 thereby defining an annular cylindrical surface 190 at the base of nozzle 188. Depending from base portion 186 in a direction opposite to nozzle 188 is a series of four substantially triangularly shaped prongs 190*a*, 190*b*, 190*c* and 190*d* each of which terminates in an apex or tip having an inside beveled surface 192 (FIG. 12). The central axis of each prong is located at 90° intervals with respect to the central axis of brush anchor 150 and together define a corresponding series of notches 194*a–d* between each pair of neighboring prongs, respectively. Coaxially located inside the array of prongs 190*a–d* is a ferrule 196 extending from base portion 186 and terminating in a beveled surface 198 whose extremity is spaced from the tips of prongs 190*a–d* a distance equal to the axial extent of ferrule 714 from annular surface 172 (FIG. 10). In addition, the taper of beveled surface 198 is complimentary to that of beveled surface 180 of ferrule 174. Also, the outside diameter of base section 186 of brush anchor 150 is slightly greater than the inside diameter of cylindrical recess 170 of brush holder 148, and the distance between surface 190 and the tips of prongs 190*a–d* is equal to the distance between juncture 168 and annular surface 172 of brush holder 148. Hence, brush anchor 150 may securely be press fit into engagement with brush holder 148 via insertion into recess 162, recess 164, and recess 170 such that surface 190 coincides with juncture 168 and beveled surface 198 of ferrule 196 tightly seats within frusto-conical recess 180 of ferrule 174, and the tips of prongs 190*a–d* engage or bottom upon surface 172.

Ferrule 196 of brush anchor 150 has a central cylindrical bore 200 which interconnects with a coaxial cylindrical bore 202 of greater diameter through a coaxial frusto-conical passage 204 to form a central or axial passage through brush anchor 150 and nozzle 188, which passage opens through the free or distal end 206 of the nozzle to form the latter's mouth.

Before interfitting brush holder 148 and brush anchor 150 together as aforesaid, tufts of brush bristles 210 (FIGS. 3–5) are wrapped around each prong 190*a–d* in a generally U-shaped manner, that is, with the inside bottom of the U being drawn tightly against annular surface 208 between the inside surface of each prong and the outside surface of confronting ferrule 196 to form a series of U-shaped tufts encircling nozzle 188. The bristles preferably are fabricated of Nylon strands cut to a suitable size, but any suitable well known brush bristle material may be employed instead.

When the brush anchor 150 and bristle tufts 210 are interfitted with brush holder 148, the bristles occupy the space between the outside surface of nozzle 188 and the inside surface of frusto-conical recess 164 between juncture 168 and juncture 166. Moreover, the tapered inside surface of recess 164 in the vicinity of juncture 166 will pinch the bristles tightly against the upper portion of the outside surface of cylindrical nozzle 188 as best viewed in FIGS. 3–5. This arrangement not only secures the bristles relative to the brush holder, but furthermore, helps to maintain a central space 212 interiorly of the bristle tuft cluster in communication with the mouth of nozzle 188 which central space 212 serves as a manifold uniformly delivering liquid cosmetic issuing from nozzle 188 to the bristle cluster from the inside out. Such "inside out" flow has been found to be advantageous in delivering a uniform layer of liquid cosmetic to the surface being painted via applicator 10. Moreover, this arrangement helps to maintain the liquid cosmetic within the interior of the brush or bristle cluster thereby avoiding excess liquid cosmetic on the outside of the cluster which, an turn, might result in a bristle hardening residue.

It will thus be appreciated that when the brush anchor 150 and bristles 210 are interfitted with brush holder 148 and the latter is interfitted with section 22 in the preferred manner indicated above, there is produced a complete bottle cap 14 sub-assembly having a central passageway extending from ferrule 114 to brush bristles 210 comprising recess 116, recess 124, bore 126, recess 182, bores 184, 185, recess 200, recess 204, and nozzle bore 202.

The final step in assembling the bottle cap 14 is to install overcap 24. The latter comprises a first outer sleeve 214 of generally frusto-conical shape and a second inner sleeve 216 also generally of frusto-conical shape. Outer 4 has a closed top end 218 and an open bottom end 220 defining a central cylindrically shaped recess 222 which opens into a larger, coaxial frusto-conical chamber 224 which, in turn, communicates with a smaller, coaxial frusto-conically shaped chamber 225. Disposed in end 220 is a pair of diametrically opposed, arcuately shaped inclined ramps 226, 228 radially spaced from the central axis of outer sleeve 214 and surrounding the opening of recess 222 with each ramp extending circumferentially in opposite directions for 180°. Thus, ramp 226 commences at point 230 recessed with respect to end 220 and rises in the counter-clockwise direction as viewed in FIG. 14 until it is flush with end 220 at point 232. Similarly, ramp 228 commences at a point 232 recessed with respect to end 220 and rises in the counter clockwise direction as viewed in FIG. 14 until it is flush with end 220 at point 230. With this arrangement, it will be understood that ramp 226 forms a flat shoulder or stop surface 234 perpendicular to the plane of FIG. 14 and as depicted in FIG. 15; whereas similarly, ramp 228 forms a flat shoulder or stop surface 236 perpendicular to the plane of FIG. 14 which faces in the opposite direction relative to shoulder 234 (a projection of which is indicated by broken lines in FIG. 15). Also, it will be observed that arcuate ramps 226, 228 are radially spaced relative to the central axis of outer sleeve 214 substantially the same extent ramps 130, 132 located on surface 106 are radially spaced from the central axis of lower section 22.

In addition to ramps 226, 228, outer sleeve 214 includes a helical groove 238 of cylindrical cross-section on the inside surface of recess 222.

Overcap inner sleeve 216 has a closed upper end 240, an opposite end 242 having a central frusto-conical recess 243 which latter opens into a coaxial frusto-conical chamber 245. The inner sleeve is generally frusto-conically shaped to conform to similarly shaped chamber 224 in outer sleeve 214, but is slightly oversized with respect thereto to facilitate secure interfitment therewith by press fitting inner sleeve 216 into chamber 224. Preferably, the inside wall surface of chamber 224 is slightly recessed as shown to facilitate snap-fitting inner sleeve 216 into position therein. Before so joining the two parts of overcap 24, a sponge-like element 248 permeated with solvent preferably is placed in chamber 225 (See FIG. 3). The sponge element is intended to emit solvent vapor through end 240 of inner sleeve for the purpose of preventing any liquid cosmetic remaining on bristles 210 from forming a hardened residue. Alternatively, a small perforation, or series of perforations (not shown), may be made in end 240 to enhance solvent vaper transmission from chamber 225 to chamber 246. Any solvent or blend of solvents capable of softening nail enamel may be used with a solvent blend comprising toluene, ethyl acetate, and butyl acetate being particularly preferred.

It will be noted at this juncture (See FIG. 3), that the frusto-conical recess 243 and frusto-conical chamber 245 are dimensioned and shaped in such manner that when overcap 24 is installed in its intended position on section 22 of bottle cap 14, the tapered inside surface of recess 243 will sealingly engage the outside beveled surface 110 of socket 100 of section 22, and frusto-conical chamber 245 will provide an air tight enclosure totally surrounding brush bristles 210.

The assembled overcap 24, comprised of interfitted sleeves 214, 216, may be attached or removed from socket 100 and surface 106 of section 22 by rotatably engaging overcap recess 222 with socket 100 (i.e., rotating the overcap clockwise relative to the socket) such that helical groove 238 engages thread 146 on outside surface 108 of socket 100 until ramps 226, 228 engage corresponding ramps 130, 132, and shoulders 234, 236 defined by ramps 226, 228 (overcap) engage corresponding shoulders 136, 140 defined by ramps 130, 132 on surface 106 of section 22. Removal of overcap 24 from section 22 may easily be effected by reversing this procedure, that is, twisting overcap 24 in a counterclockwise direction relative to section 22. Because ramps 130 and 132 rise to their full height in 90° of angular extent of surface 106, the overcap will completely be disengaged from socket thread 146 in less than one full turn or twist of the overcap.

When the overcap 24 is engaged with section 22 and the container 12 is filled with a liquid cosmetic, the assembled bottle cap 14 may be interfitted with container 12 and sealing plug 46. Such interfitment requires slight resilient deformation of section 22 relative to male thread 42 on container neck 38. For this reason, the material of section 22 is selected to be softer or more resiliently yieldable than the BARAX 210 acrylic thermoplastic material of container 12. A suitable such material for section 22, particularly preferred for use with the present invention, is molded polypropylene.

Referring again to FIG. 3, the assembled bottle cap 14 is threadedly engaged with thread 42 on container neck 38 through the bottle cap's central opening 88 by positioning the bottle cap on top of the container neck and rotating the bottle cap clockwise relative to the container. Such rotation and thread engagement will cause the bottle cap to axially displace downwardly as viewed in FIGS. 3–5 whereupon the bottom beveled surface 242 of stop ring 96 will interfere with the upper beveled surface 244 of container neck stop ring 44. However, since the material of section 22 is resiliently yieldable with respect to the material of stop ring 44, upon further rotation of bottle cap 14, the beveled engagement between surfaces 242, 244 will result in a camming action between these surfaces of sufficient force to cause the frusto-conical wall 84 of section 22 in the region of stop ring 96 to radially dilate or expand outwardly enabling stop ring 96 to slide downwardly and over stop ring 44, until the former entirely clears the latter, and then returns substantially to its original shape and dimensions. Upon yet further rotation, bottle cap 14 will continue to displace axially downwardly until surface 128 bottoms upon flange upper surface 60 of sealing plug 46 in the position shown in FIG. 3. When this occurs, no further clockwise rotation or corresponding downward axial displacement of bottle cap 14 relative to container neck 38 is possible. It will be noted that as a result of reaching the above-described limit position illustrated in FIG. 3, beveled surface 74 will be sealingly seated within recess 124, thereby closing off any flow of liquid cosmetic through the central or axial flow passageway leading to bristle cluster 210. Further sealing action occurs between the tight interfitment comprised of the outside surface 129 of ferrule 114 and the inside surface 52 of sealing plug 46, thus preventing leakage of liquid cosmetic between these surfaces, despite inadvertent squeezing of the walls of container 12. It will be appreciated that alternatively, section 22 may first be assembled with the filled container 12 in the above manner followed by subsequent installation of overcap 24 via rotatable engagement with socket 100 as also described above.

In accordance with the invention, applicator 10 preferably is used as follows. First, overcap 24 is removed by twisting this part counterclockwise less than one full turn relative to section 22. Next, section 22 is rotated relative to container 12 from the rest or "fully closed" position shown in FIG. 3 in the same counter-clockwise direction a desired angular extent to accordingly open the central passageway between container 12 and brush bristles 210. Alternatively, section 22 may be rotated first to a desired "open" position and then the overcap 24 removed. In either event, it is then a simple matter to apply a smooth, even layer of liquid cosmetic to a selected surface by gripping container 12, say, between the thumb and forefinger of one hand, and gently squeezing walls 30, 32 toward one another while simultaneously stroking brush bristles 210 across and in engagement with the surface being painted which typically will comprise one of the fingernails on say, the other hand.

Referring to FIG. 3, it will be understood that counter-clockwise rotation of section 22 (and/or bottle cap 14) causes upward, axial displacement of these parts until the upper surface 246 of beveled stop ring 96 abuttingly engages the flat undersurface or annular shoulder 248 provided by container neck stop ring 44. When this occurs, further rotation and/or axial displacement of section 22 upwardly relative to container 12 is prevented because surface 248 is substantially flat, and thus, insufficient camming forces are present between surfaces 246, 248 to resiliently deform wall 84 of section 22 and thereby enable stop ring 96 to ride over and beyond stop ring 44. This predetermined limit position where surface 246 abuttingly engages annular shoulder 248 is shown in FIG. 5, and in the preferred embodiment illustrated, occurs in approximately seven eights (7/8ths) of a full turn of section 22 counter-clockwise relative to container neck portion 38 (or container 12).

It will be observed that in the "fully open" position of FIG. 5, beveled surface 74 of valve stem 66 is fully disengaged from frusto-conical seating recess 124. Accordingly, liquid cosmetic under pressure from the action of squeezing the walls 30, 32 of container 12 toward one another is urged to flow through container neck recess 40, sealing plug recess 54, slots, 70, recess 52, recess 116 of ferrule 114, valve seat recess 124, bore 126, recess 182 in brush holder 140, bores 184, 185, bore 200 of brush anchor ferrule 196, recess 204, and cylindrical passage 202 of nozzle 188 into the central space 212 of bristle cluster 210. All of the while, sealing against leakage is preserved by the tightly interfitting engagement of the outside surface 129 of ferrule 114 and the inside surface 52 of sealing plug 46.

In accordance with an important feature of the present invention, the amount of liquid cosmetic caused to flow through the central or axial passageway extending between the interior of container 12 and bristles 210 as a result of squeezing or deforming the flexible walls of container 12 may precisely be regulated between the fully closed position of FIG. 3 and the fully open position of FIG. 5 by merely rotating section 22 or bottle cap 14 to a selected intermediate position between these extremes. Hence, FIG. 4 illustrates the relationship of parts when the flow control ring i.e., section 22, is rotated approximately half-way between the limit positions defined in FIGS. 3 and 5, respectively. As seen in FIG. 4, there still is clearance between the beveled surface 74 of valve stem 66 and frusto-conical recess 124 albeit the cross-sectional area of the flow passage defined by beveled surface 74 on valve stem 66 and the frusto-conical recess 124 in wall 122 is not as large as that when section 22 is rotated to the fully open position of FIG. 5. Thus, as depicted in FIG. 4, there will be corresponding reduction in liquid cosmetic flowing through the central passageway from container 20 to brush bristles 210 upon squeezing action applied to the flexible walls of container 12 with an intermediate setting of the flow control means of the present invention.

As described above, the bottom portion of section 22 carries rotation scale indicia 20 for cooperation with index mark 16 on container 12 to provide a visible reference for the relative angular rotation of section 22 on container neck portion 38. And, as also mentioned above, in its preferred form, such rotation scale indicia 20 comprises four circumferentially spaced sets of vertical projections on the outer peripheral surface portion of section 22 adjacent to edge 89 with each successive set having one more projection then the immediately preceeding set i.e., the sets number one projection, two projections, three projections, and four projections, respectively. The sets of projections are so spaced on the outer surface of section 22 that, as shown in FIG. 5a, alignment of the highest numbered set (the one with four projections) with index mark 16 will indicate the "fully open" position corresponding to the relationship of parts as shown in FIG. 5. In this position, maximum flow of liquid cosmetic through the central passageway leading between container 12 and brush cluster 210 will be obtained for a given 10 "squeeze" force applied to opposed flexible walls 30, 32 of the container. More or less flow may be obtained by either varying the squeeze pressure or rotating the flow control ring (section 22) clockwise to say, a position where the set of rotation scale indicia 20 comprising two projections is aslgined with index mark 16.

This "intermediate" position is indicated in FIG. 4*a* and corresponds to a relationship of parts as illustrated in FIG. 4. In connection therewith, it will be noted that rotation of section 22 clockwise causes downward axial displacement of the entire sub-assembly comprising section 22 and brush holder 28 (and/or overcap 24) relative to valve stem 66 thereby reducing the cross-sectional flow area between beveled surface 74 and frusto-conical recess 124. Owing to such downward axial displacement, the clearance between bottom edge 89 of section 22 and flange 18 of container 12 also is reduced accordingly as depicted in FIGS. 5*a* and 4*a* (compare also FIGS. 5 and 4).

Yet still further clockwise rotation of section 22 will result in further downward axial displacement of the aforementioned sub-assembly until beveled surface 74 seats tightly within frusto-conical recess 124, entirely closing off the central passageway between container 12 and brush bristles 210. In this relative position of parts, shown in FIG. 3, the index mark 16 will be aligned approximately at the midpoint between the set of rotation scale indicia 20 having one projection and that set of indicia having four projections as depicted in FIG. 3*a*. In such position, i.e., the "fully closed" position, it will be observed that surface 128 has bottomed upon surface 60 of flange 56 thereby preventing further clock-wise rotation of section 22.

Although the "fully open" (FIGS. 5, 5*a*), "fully closed" (FIGS. 3, 3*a*), and "intermediate" (FIGS. 4, 4*a*) positions have been shown and described above in great detail, it will be appreciated that the flow control ring (lower section 22) may be displaced or rotated to any desired position between "fully closed" and "fully open;" that is, the adjustable flow control means of the present invention is continuously or infinitely variable between such positions. Moreover, any desired or selected position of the flow control ring may be repeated during subsequent uses of applicator 10 by remembering the corresponding visual relationship between index mark 16 and rotation scale indicia 20 and rotating section 22 to this same angular position relative to index mark 16 prior to each such successive use. This is so despite the fact that no exact alignment may exist between index mark 16 and a particular set of rotation scale indicia. Thus, for example, in the preferred arrangement, where the flow control ring is rotated to say, a "three-quarter open position", index mark 16 will be aligned approximately halfway between the set of indicia 20 having three projections and that set having four projections.

In passing, it is to be realized that although FIG. 2 illustrates a vertical orientation of applicator 10 with the brush tuft 26 on top of container 12 and facing upwardly, during typical usage the brush will be pointed down or oriented toward the fingernail or other surface being painted and thus, gravity will aid the flow of liquid cosmetic from the container to the brush bristles.

Also, during rotation of section 22, the eccentric spike 78 atop valve stem 66 traces a relatively wide circumferential path interiorly of frusto-conical recess 124 and through bore 126. Hence, should any liquid cosmetic material in the form of a hard residue be deposited in these locations between successive uses of applicator 10, the motion of spike 78 relative to section 22 will tend to dislodge such resude and permit free flow of liquid cosmetic material therethrough upon subsequent use of the applicator.

After the liquid cosmetic has been applied to the surface to be painted via manual manipulation of cosmetic applicator 10, the user merely rotates section 22 clockwise as viewed in FIG. 2 to return the parts to the closed condition of FIG. 3. The removed overcap 24 may then be emplaced to protect and maintain the brush bristles in an air tight enclosure. Alternatively, the flow control ring or section 22 may be left in its desired open position and the overcap 24 rotated into place relative to section 22. While the central flow passageway remains open under such conditions, leakage through the brush bristles may nevertheless be avoided by preventing squeezing or deformation of the walls of container 12.

From the above description, it should now be evident that the preferred embodiment of the present invention, accomplishes each and every objective sought. As disclosed, applicator 10 comprises a "squeezable" liquid cosmetic container having an integral brush assembly such that the device substantially is unbreakable, nonleaking, and unspillable, yet may be manipulated conveniently with only one hand when in use. By virtue of the disclosed adjustable flow control means interposed between the brush bristles and the container, the amount of liquid cosmetic caused to flow for a given squeeze force may be selected and/or continuously varied over a relatively wide range. Finally, because the individual parts of the described applicator may easily be fabricated by molding in a known manner from commercially available polymeric resinous materials, and subsequently assembled together in the relatively simple manner described above, the resulting article is relatively inexpensive to manufacture and purchase.

The foregoing detailed description of the preferred embodiment of the present invention has been made as required by statute and should not be construed as limiting. For example, it is not necessary for overcap 24 to be rotatably affixed to section 22. Instead, overcap 24 may be provided with a detent or latch for cooperating with similar means on section 22 and merely snapped into place, or even affixed via an interference fit on section 22 after the bottle cap (i.e., section 22) has been returned to the "fully closed" position of FIGS. 3 and 3*a*. Likewise, it will be apparent that other forms of indicia may be employed in lieu of index mark 16 and rotation scale projections 20 to mark the relative angular relation between the flow control ring 22 and container 12 e.g., various combinations of numerals, letters, or any other graphic symbols of choice either molded in place, painted on, or affixed in any other convenient way to section 22 (bottle cap 14) may be employed instead. Also, it should be understood that applicator 10 may be used to apply liquids or liquid cosmetics other than nail enamel such as, for example, fragrance containing compositions, liquid eye make-up, skin creams and lotions, and so on.

Obviously, many additional modifications and variations will occur to those of ordinary skill in the art. Accordingly applicants' contribution should be restricted only by the true spirit and scope of the appended claims.

We claim:

1. Apparatus for applying a liquid to a surface comprising a container for storing a liquid, said container having at least one flexible portion adapted to be squeezably displaced, brush means for applying liquid in said container to said surface, passageway means between said container and said brush means in which liquid is caused to flow from said container to said brush means for application to said surface when said at least one portion of said container is squeezably displaced, and adjustable means interposed in said passageway means to control the amount of liquid flowing therethrough.

2. The apparatus of claim 1 further comprising cap means on said container, said brush means being disposed on said cap means, said passageway means extending at least in part through said cap means, wherein said ajustable means is responsive to displacement of said cap means relative to said container to control the amount of liquid flowing therethrough.

3. The apparatus of claim 2 wherein said adjustable means comprises sealing means affixed to said container between said container and said cup means, said passageway means extending at least in other part through said sealing means, and wherein said sealing means includes means for cooperating with said cap means to adjust the cross-sectional area of said at least part of said passageway means extending through said cap means in response to displacement of said cap means.

4. The apparatus of claim 2 further comprising indicia associated with said container for indicating the extent of adjustment of said adjustable means.

5. The apparatus of claim 3 wherein said cap means has disposed thereon indicia for indicating the extent of adjustment of said cross-sectional area of said at least part of said passageway means.

6. The apparatus of claim 2 further including first means for defining a first limit position for displacement of said cap means, and seçond means for defining a second limit position for displacement of said cap means wherein said at least part of said passageway means is closed in said first limit position and is open to a maximum extent in said second limit position.

7. The apparatus of claim 2 wherein said cap means further comprises socket means communicating with said passageway at one end thereof;

said brush means comprising a tubular body having a central bore communicating with openings in opposite ends thereof, nozzle means disposed interiorly of said bore, and a circumferential array of brush bristles disposed between said nozzle and said tubular body, said brush bristles extending from said tubular body and said nozzle through one of said openings in one end of said tubular body;

wherein said other end of said tubular body is receivably supported within said socket such that said other of said openings communicates with said passageway whereby liquid from said storage container is capable of flowing through said other openings, said nozzle and into the center of said circumferential array of said brush bristles.

8. The apparatus of claim 2 wherein said cap means further includes removable enclosure means for enclosing said brush means in an air-tight manner.

9. The apparatus of claim 7 wherein said cap means further includes removable enclosure means for enclosing said brush means in an air-tight manner, said enclosure means adapted to be removably engageable with said socket means such that the interior volume defined by said enclosure means completely surrounds said tubular body and said brush bristle extending therefrom when said enclosure means engages said socket means as aforesaid.

10. The apparatus of claim 3 wherein said means for cooperating with said cap means comprises valve stem means, said at least part of said passageway means extending through said cap means being engaged by said valve stem means in response to displacement of said cap means whereby the cross-sectional area of the flow path defined by said at least part of said passageway means can be continuously adjusted between zero and a predetermined maximum.

11. The apparatus of claim 10 wherein said cap means further comprises socket means communicating with said passageway at one end thereof;

said brush means comprising a tubular body having a central bore communicating with openings in opposite ends thereof, and brush bristles extending from said tubular body central bore through one of said openings in one end of said tubular body;

wherein said other end of said tubular body being receivably supported in said socket means such that said other of said openings communicates with said passageway whereby in the absence of said valve stem means engaging said at least part of said passageway sufficiently to reduce the cross-sectional area thereof to zero, liquid from said storage container is urged to flow upon deformation of said container's flexible walls through said other part of said passageway in said sealing means, said at least part of said passageway in said cap means, said central bore in said tubular body, and said brush bristles.

12. The apparatus of claim 3 wherein said sealing means further includes means for confining flow of said liquid through said at least other part of said passageway and said at least part of said passageway, said means for confining flow of said liquid sealingly engaging said cap means during displacement thereof relative to said container.

13. The apparatus of claim 10 wherein said predetermined maximum adjustment is determined by maximum displacement of said cap means relative to said valve stem means, and said cap means includes means for cooperatively engaging stop means on said container to define said maximum displacement.

14. The apparatus of claim 13 wherein said container means comprises a neck portion at one end thereof having an opening therethrough communicating with the interior of said container, and said cap means comprises a substantially cylindrical body member having a opening at one end defining a recess therein, said recess having disposed therein helical thread engagement means for cooperating with complimentary helical thread engagement on the outside surface of said container neck portion whereby said cap means may be rotationally threadedly engaged on said neck portion and caused to axially displace relative to said neck portion opening;

and wherein said cap means means for cooperatively engaging stop means on said container comprises a first shoulder on the inside surface of said cylindrical body recess, and wherein said stop means on said container comprises a second shoulder on the outside surface of said container neck portion, said second shoulder adapted to abuttingly engage said first shoulder in response to predetermined displacement of said cap means relative to said container neck portion.

15. The apparatus of claim 1 wherein said flexible container is fabricated of a molded acrylic thermoplastic resin.

16. The apparatus of claim 1 wherein said container comprises at least a pair of opposed front and rear walls and at least a pair of opposed side walls, at least one of said pair of front and rear walls having a wall thickness varying along the height thereof, the upper portion of said wall being approximately 25% thinner in transverse cross-sectional thickness than the lower portion of said wall.

17. The apparatus of claim 14 wherein said container is fabricated from a first material and said cap means is fabricated from a second material being more resiliently deformable than said first material.

18. The apparatus of claim 17 wherein said first material is an acrylic thermoplastic resin and said second material is polypropylene.

19. The apparatus of claim 8 wherein said removable enclosure means comprises means interiorly thereof for maintaining any liquid or said brush means in a softened condition.

20. The apparatus of claim 19 wherein said last mentioned means comprises means for storing a solvent interiorly of said removable enclosure means.

* * * * *